US005239123A

United States Patent [19]

Fujita

[11] Patent Number: 5,239,123

[45] Date of Patent: Aug. 24, 1993

[54] ELECTRONIC MUSICAL INSTRUMENT

[75] Inventor: Yoshio Fujita, Hamamatsu, Japan

[73] Assignee: Yamaha Corporation, Hamamatsu, Japan

[21] Appl. No.: 923,302

[22] Filed: Jul. 30, 1992

Related U.S. Application Data

[63] Continuation of Ser. No. 464,954, Jan. 16, 1990, abandoned.

[30] Foreign Application Priority Data

Jan. 17, 1989 [JP] Japan ..... 1-8232

[51] Int. Cl.[5] ..... G10H 1/06; G10H 704

[52] U.S. Cl. ..... 84/605; 84/622; 84/659; 84/453

[58] Field of Search ..... 84/605, 622-625, 84/659-661, 723-742, 453

[56] References Cited

U.S. PATENT DOCUMENTS

Re. 31,019 8/1982 Evangelista ..... 84/738 X 4,882,965 11/1989 McClish ..... 84/453 X

FOREIGN PATENT DOCUMENTS 59-166296 11/1984 Japan .

*Primary Examiner*—Stanley J. Witkowski

*Attorney, Agent, or Firm*—Graham & James

[57] ABSTRACT

An electronic musical instrument capable of generating a musical tone sounded from a string instrument played with bow provides a memory and a bowing control for inputting bowing operation information indicative of a bowing direction, i.e., up-bow and down-bow. The memory pre-stores musical tone waveform data representative of musical tone waveforms generated by playing the string instrument with bow. Then, by reading out the musical tone waveform data by the speed corresponding to pitch information, a musical tone signal corresponding to the read musical tone waveform data is to be generated. Based on the bowing direction, the tone color of the musical tone signal is to be controlled.

8 Claims, 12 Drawing Sheets

| | | ST="1" | | ST="0" | |
|---|---|---|---|---|---|
| | | FWD="1" | FWD="0" | FWD="1" | FWD="0" |
| TONE COLOR A | START ADDRESS | $A_0$ | $A_0$ | As | Ae |
| | END ADDRESS | Ae | Ae | Ae | As |
| TONE COLOR B | START ADDRESS | $B_0$ | $B_0$ | Bs | Be |
| | END ADDRESS | Be | Be | Be | Bs |
| | | | | | |
| TONE COLOR N | START ADDRESS | $N_0$ | $N_0$ | Ns | Ne |
| | END ADDRESS | Ne | Ne | Ne | Ne |

| | | ST="1" | | ST="0" | |
|---|---|---|---|---|---|
| | | FWD="1" | FWD="0" | FWD="1" | FWD="0" |
| TONE COLOR A | START ADDRESS | $A_3$ | $A_0$ | $A_1$ | $A_2$ |
| | START ADDRESS | $A_3s$ | $A_0s$ | $A_1e$ | $A_2s$ |
| | END ADDRESS | $A_3e$ | $A_0e$ | $A_1e$ | $A_2e$ |
| TONE COLOR B | START ADDRESS | $B_3$ | $B_0$ | $B_1$ | $B_2$ |
| | START ADDRESS | $B_3s$ | $B_0e$ | $B_1e$ | $B_2e$ |
| | END ADDRESS | $B_3e$ | $B_0e$ | $B_1e$ | $B_2e$ |
| | ⋮ | ⋮ | ⋮ | ⋮ | ⋮ |
| TONE COLOR N | START ADDRESS | $N_3$ | $N_0$ | $N_1$ | $N_2$ |
| | START ADDRESS | $N_3s$ | $N_0s$ | $N_1s$ | $N_2s$ |
| | END ADDRESS | $N_3e$ | $N_0e$ | $N_1e$ | $N_2e$ |

FIG. 9

ELECTRONIC MUSICAL INSTRUMENT

This is a continuation of copending application Ser. No. 07/464,954 filed on Jan. 16, 1990 and now abandoned.

BACKGROUND OF THE INVENTION

1. Field of the Invention

The present invention relates to an electronic musical instrument capable of generating a musical tone of a string instrument played with bow.

2. Prior Art

Conventionally, Japanese Utility Model Laid-Open Publication No. 59-166296 discloses an electronic musical instrument capable of generating a musical tone sounded from a string instrument played with bow (hereinafter, simply referred to as a string bowing instrument), such as a violin, cello and the like. This electronic musical instrument provides a waveform memory which pre-stores musical tone waveforms generated from the string bowing instrument. Then, by repeatedly reading out the pre-stored musical tone waveforms, the musical tones of the string bowing instrument are to be generated.

If the tone color can be varied in response to a personal difference in a bowing operation when playing the string bowing instrument, the reproductivity of the musical tones of string bowing instrument (hereinafter, simply referred to as string bowing instrument tones) can be further improved in the electronic musical instrument.

When playing the string bowing instrument such as the violin, the string bowing instrument tones are varied in its tone color by every bowing operation. For example, when playing the string bowing instrument, the sound generated by moving the bow in forward or upward direction or from right to left (hereinafter, referred to as up-bow) is slightly different from the sound generated by moving the bow in backward or downward direction or from left to right (hereinafter, referred to as down-bow) in the tone color. In fact, such delicate difference in tone color of the string bowing instrument tones in up-bow and down-bow is effective when carrying out the solo performance on the string bowing instrument. By use of the difference between the tone colors in up-bow and down-bow, it is possible to express the phonic imagination full of variety by playing the string bowing instrument.

SUMMARY OF THE INVENTION

It is accordingly a primary object of the present invention to provide an electronic musical instrument capable of reproducing the string bowing instrument tone whose tone color is slightly varied by up-bow and down-bow operations.

In a first aspect of the present invention, there is provided an electronic musical instrument comprising:

(a) input means capable of inputting bowing operation information;

(b) detecting means for detecting a bowing direction based on the bowing operation information;

(c) memory means for storing musical tone waveform data representative of musical tone waveforms generated from a string instrument played with bow (d) pitch information generating means for generating pitch information;

(e) musical tone signal generating means for reading out the musical tone waveform data by a speed corresponding to the pitch information to thereby generate a musical tone signal based on read musical tone waveform data; and (f) control means for controlling a read-out address at which the musical tone waveform data is to be read out in response to the bowing direction detected by the detecting means, so that the control means controls a tone color of the musical tone signal in response to the bowing direction.

In a second aspect of the present invention, there is provided an electronic musical instrument comprising:

(a) input means capable of inputting bowing operation information;

(b) detecting means for detecting a bowing direction based on the bowing operation information;

(c) memory means for storing a plurality of musical tone forming data corresponding to bowing directions;

(d) pitch information generating means for generating pitch information;

(e) musical tone signal generating means for reading out the musical tone forming data by a speed corresponding to the pitch information to thereby generate a musical tone signal based on read musical tone forming data; and (f) control means for designating one of the plurality of musical tone forming data corresponding to the bowing direction detected by the detecting means, whereby the control means controls a tone color of the musical tone signal corresponding to designated musical tone forming data in response to the bowing direction.

In a third aspect of the present invention, there is provided an electronic musical instrument comprising:

(a) operating means for carrying out a bowing operation;

(b) generating means for generating bowing information responsive to the bowing operation;

(c) tone control information generating means for generating tone control information corresponding to the bowing information; and (d) musical tone signal generating means for generating a musical tone signal in accordance with the tone control information.

In a fourth aspect of the present invention, there is provided an electronic musical instrument comprising:

(a) input means capable of inputting a bowing operation information;

(b) detecting means for detecting a bowing direction based on the bowing operation information;

(c) pitch information generating means for generating pitch information;

(d) tone control information generating means for generating tone control information corresponding to the bowing direction detected by the detecting means; and (e) musical tone signal generating means for generating a musical tone signal having a pitch corresponding to the pitch information and a tone color corresponding to the tone control information.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIG. 9 shows a table indicating address control conditions to be used in the second embodiment;

DESCRIPTION OF PREFERRED EMBODIMENTS

[A] BASIC CONFIGURATION AND OPERATION OF THE PRESENT INVENTION

First, description will be given with respect to the basic configuration and operation of the present invention by referring to FIGS. 1 and 8.

Figure 1A:
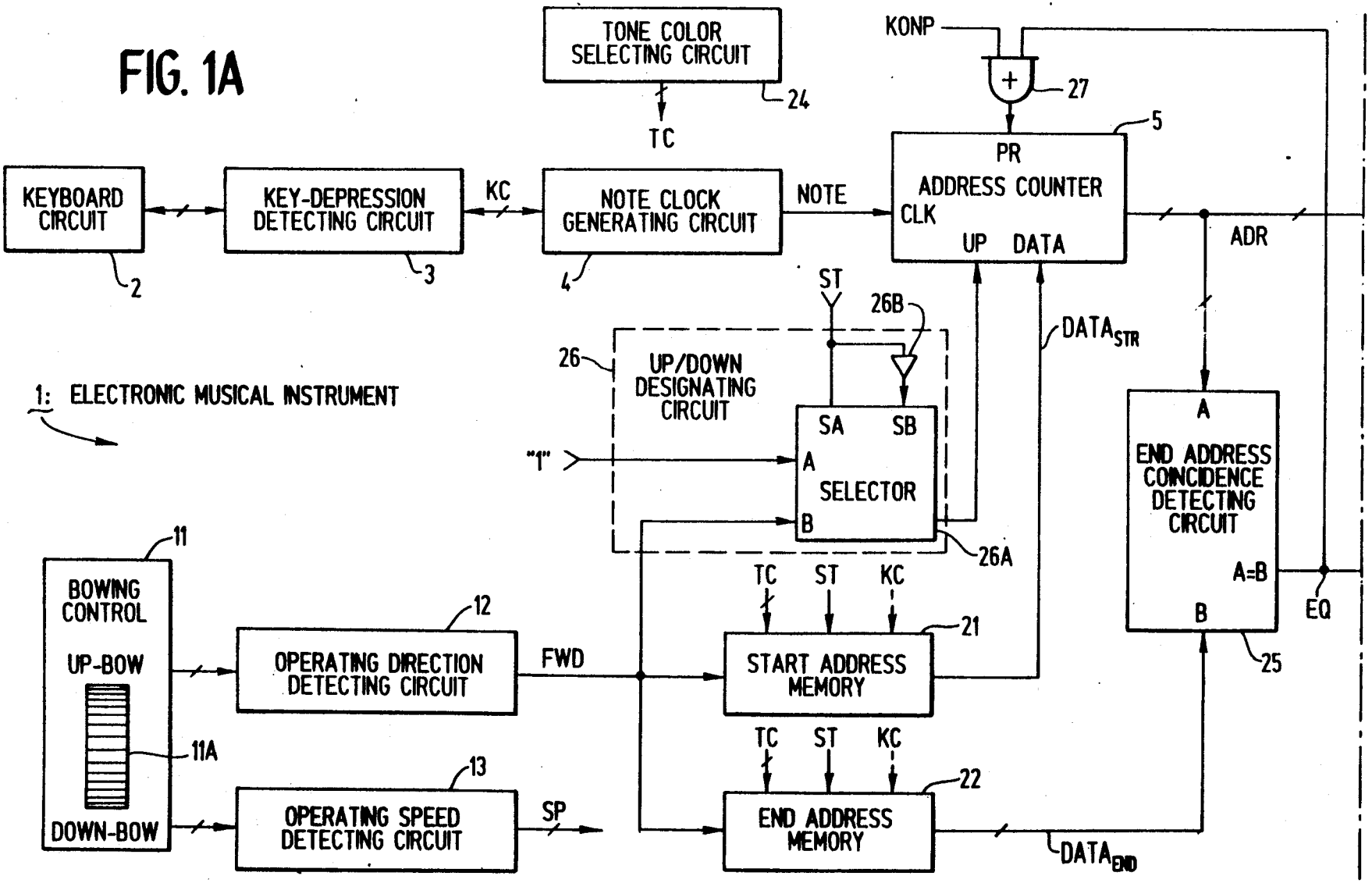
FIG. 1*a–b* is a block diagram showing a whole configuration of an electronic musical instrument according to a first embodiment of the present invention.
Figure 1B:
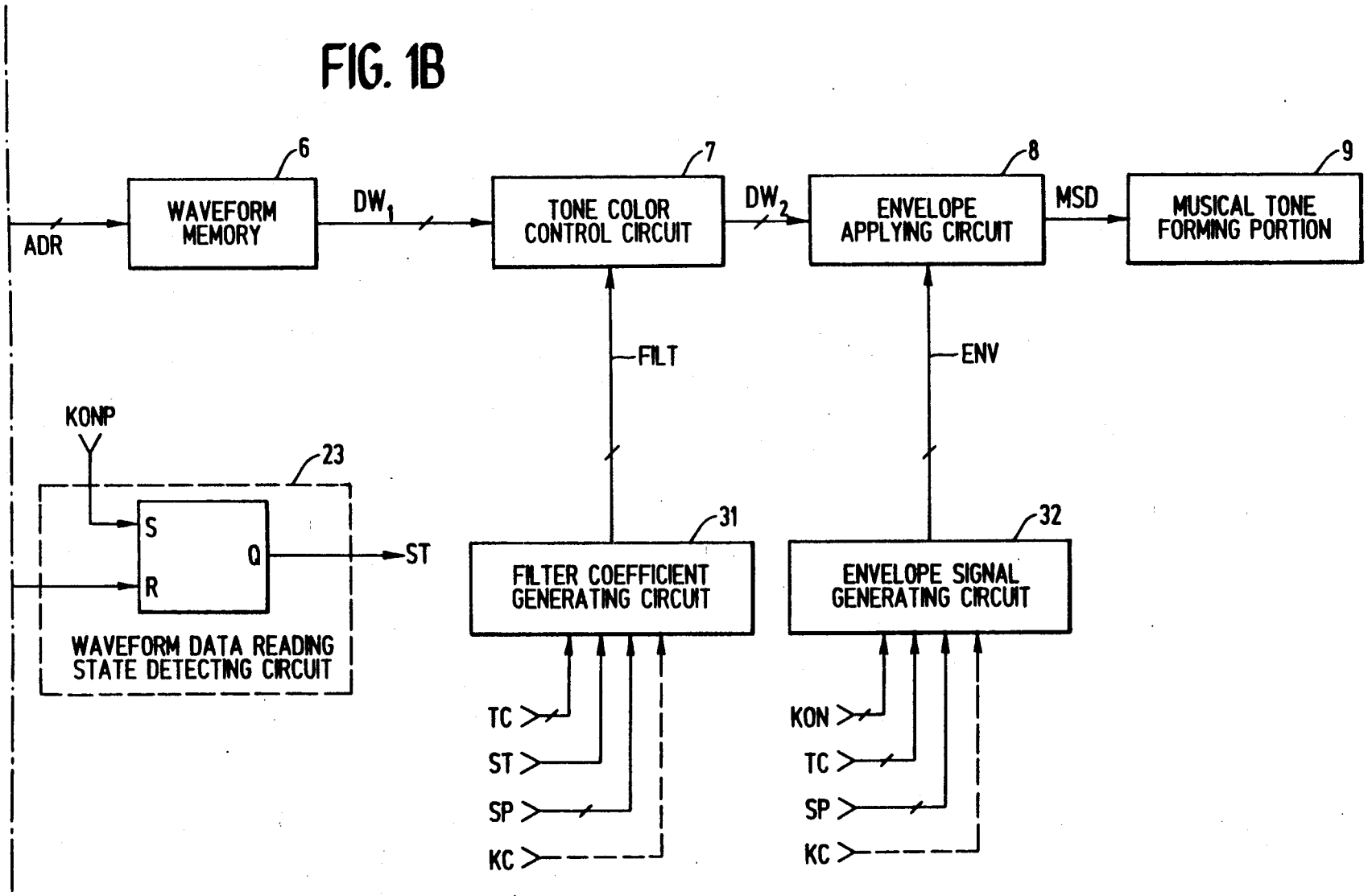

According to a first configuration of the present invention as shown in FIG. 1, the electronic musical instrument provides a bowing control 11 as the input means for inputting the bowing operation information; bowing direction detecting means 12 for detecting the bowing direction based on the bowing operation information; musical tone signal generating means 6 which reads out pre-stored musical tone waveform data WA-WN by the speed corresponding to pitch information NOTE generated from pitch information generating means 2, 3, 4 to thereby generate a musical tone signal DW1; and control means 21, 22 which controls the tone color of musical tone signal DW1 in response to the bowing direction of bowing control 11 to be operated by controlling read-out addresses of musical tone waveform data WA-WN in response to the bowing direction detected by bowing direction detecting means 12.

Figure 8A:
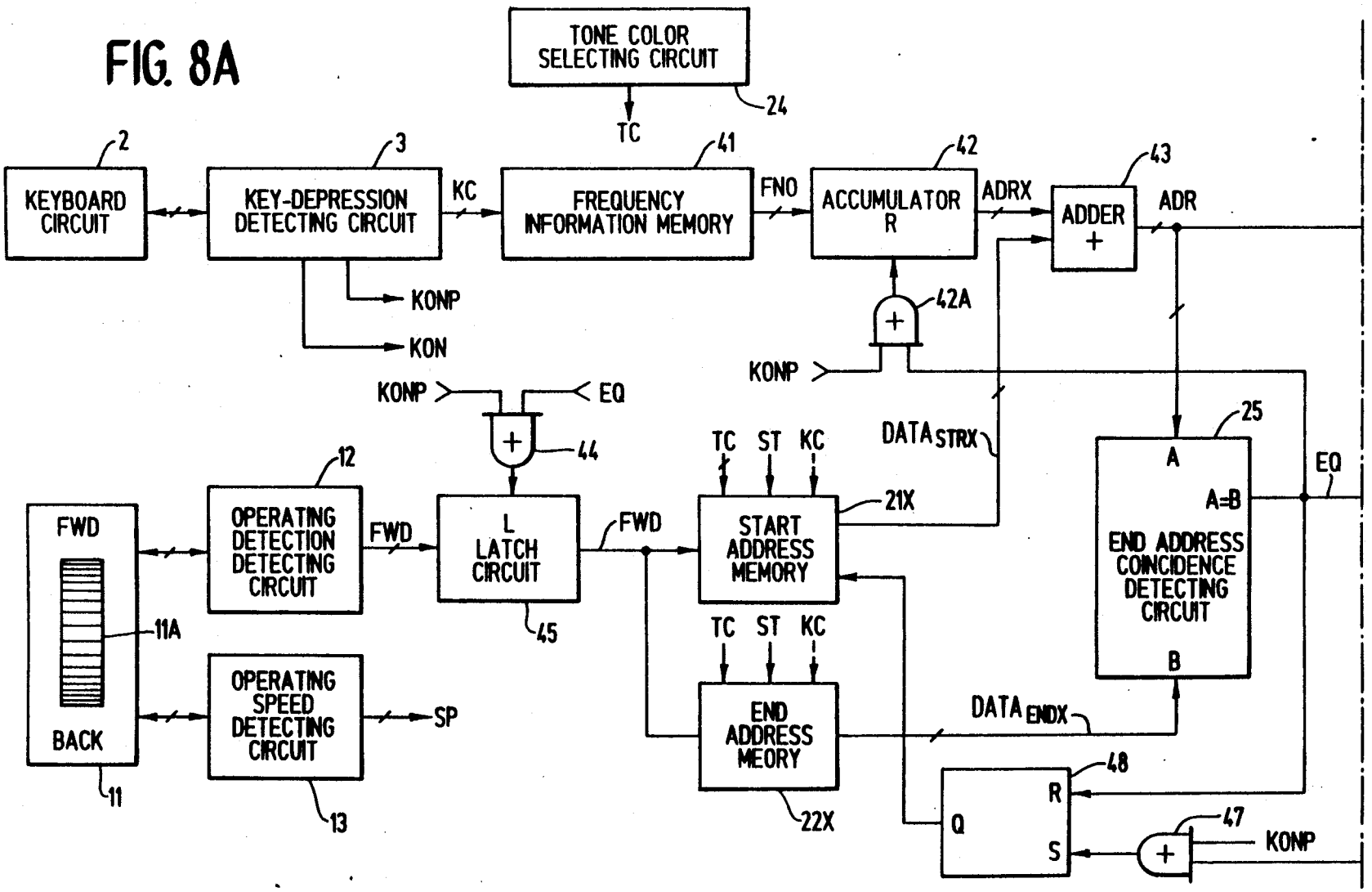
FIG. 8*a–b* is a block diagram showing an electronic musical instrument according to a second embodiment of the present invention.
Figure 8B:
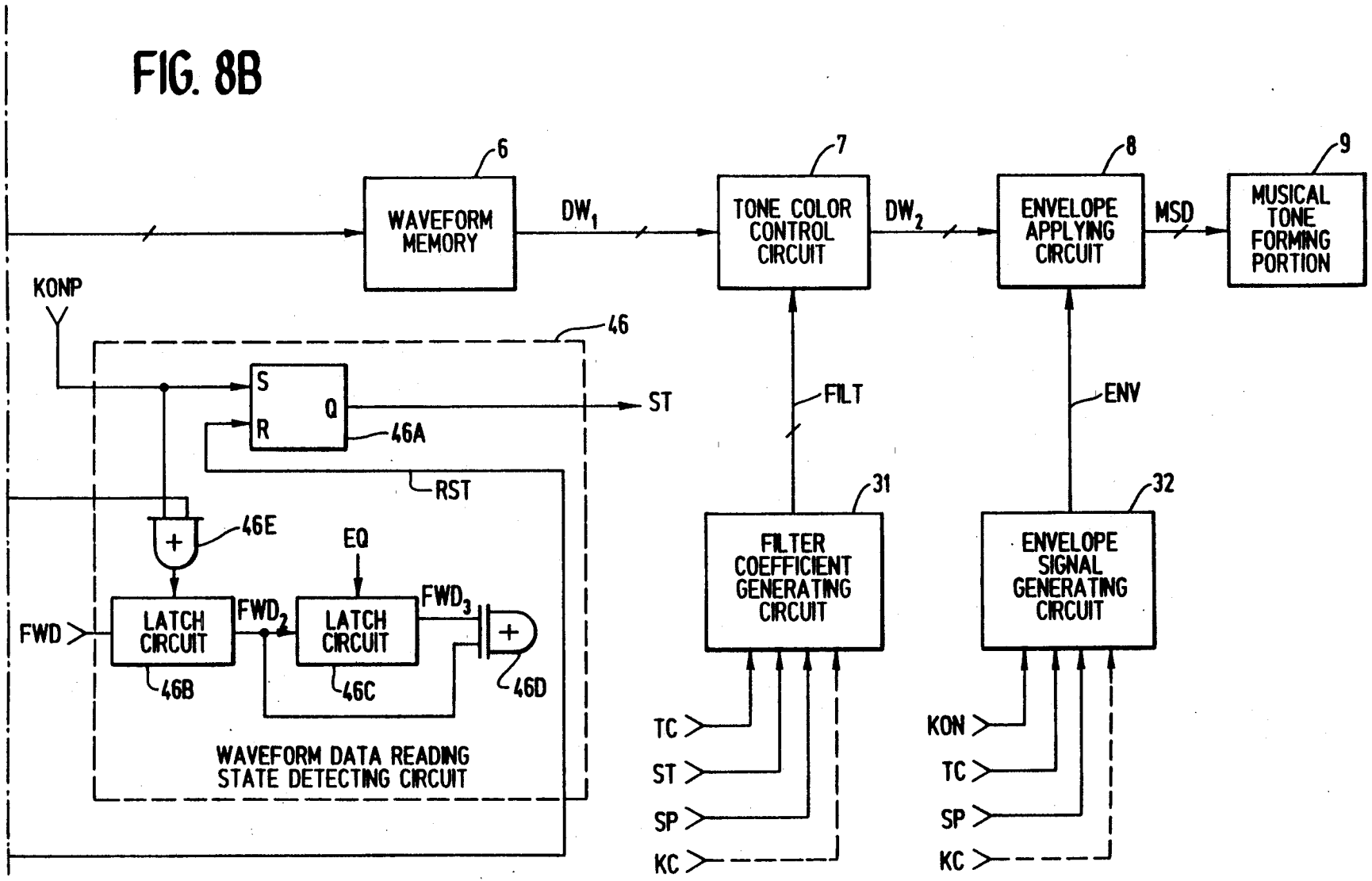

According to a second configuration of the present invention as shown in FIG. 8, the electronic musical instrument provides the bowing control 11 for inputting the bowing operation information; the bowing direction detecting means 12 for detecting the bowing direction based on the bowing operation information; the musical tone signal generating means which pre-stores a plurality of musical tone forming data ($W_{ATF}$, $W_{LPF}$), ($W_{ATB}$, $W_{LPB}$) corresponding to the bowing directions and then reads out pre-stored musical tone forming data by the speed corresponding to the pitch information generated from pitch information generating means 2, 3, 4 to thereby generate the musical tone signal DW1; and control means 21X, 22X which controls the tone color of the musical tone signal DW1 in response to the bowing direction of the bowing control 11 by designating the musical ton forming data corresponding to the bowing direction detected by the bowing direction detecting means 12 within a plurality of musical tone forming data.

In the above-mentioned configurations of the present invention, the desirable musical tone waveform data, musical tone forming data is selectively read out in response to the operation of the bowing control 11. Thus, like the real performance of the non-electronic string bowing instrument, the electronic musical instrument according to the present invention can offer the delicate variation to the tone color of the string bowing instrument tones in response to the operation of the bowing control 11.

[B] FIRST EMBODIMENT

(1) Configuration of First Embodiment

Next, description will be given with respect to the first embodiment of the present invention (corresponding to the first configuration described before) by referring to FIG. 1.

In FIG. 1, 1 designates an electronic musical instrument as a whole, and 2 designates a keyboard circuit corresponding to a keyboard 14 (shown in FIG. 3) having plural keys. When any one key is depressed in the keyboard circuit 2, a key-depression detecting circuit 3 detects the key-depression event and then generates a key code signal KC indicative of the key code of the depressed key, a key-on pulse signal KONP indicative of the key-on timing and a key-on signal KON indicating the state where the key is depressed.

The key code signal KC is fed to a note clock generating circuit 4, from which a note clock signal NOTE having the frequency corresponding to the key code signal KC is to be generated. This note clock signal NOTE is supplied to clock terminal CLK of an address counter 5.

The address counter 5 is constructed as the preset counter, so that its count value is supplied to a waveform memory 6 as an address signal ADR.

Figure 2A:
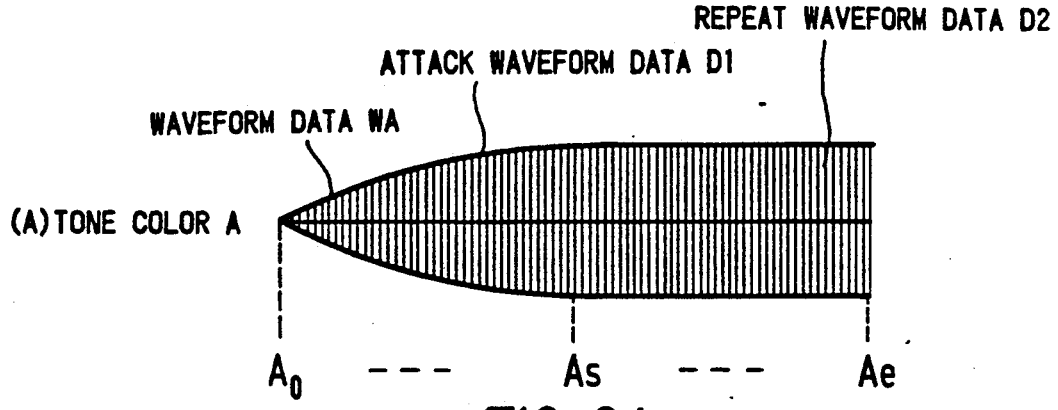
FIG. 2 shows waveforms indicated by waveform data stored in a waveform memory shown in FIG. 1.

The waveform memory 6 stores sample value waveform data WA, WB, . . . , WN indicating plural tone colors A, B, . . . , N of the string bowing instrument tones as shown in FIGS. 2(A) to 2(N). Herein, attack waveform data D1 indicative of the attack portion of the string bowing instrument tone waveform is stored in the memory area between head address Ao, Bo, . . . , No and repeat start address As, Bs, . . . , Ns of each of waveform data WA, WB, . . . , WN. In addition, repeat waveform data D2 indicative of the repeat portion of the string bowing instrument tone waveform which is formed when the bowing operation becomes stable is stored in the memory area between repeat start address As, Bs, . . . , Ns and end address Ae, Be, . . . , Ne.

The musical tone waveform signal DW1 read from the waveform memory 6 is supplied to a tone color control circuit 7 constructed by the digital filter. Then, the tone color control circuit 7 controls the tone color of the musical tone waveform signal DW1 to thereby generate a musical tone waveform signal DW2, which is sent to an envelope applying circuit 8. This envelope applying circuit 8 applies the desirable envelope to the musical tone waveform signal DW2 to thereby generate a musical tone signal MSD, which is sent to a musical tone forming portion 9 providing a digital-to-analog converting circuit and a sound system (not shown). Thus, the musical tone forming portion 9 converts the musical tone signal MSD into the corresponding string bowing instrument tone.

In the present embodiment, variation of the tone color between up-bow and down-bow is to be controlled by an operating direction detecting signal FWD and an operating speed detecting signal SP which are respectively obtained from an operating direction detecting circuit 12 and an operating speed detecting circuit 13 in response to the bowing operation of the bowing control 11.

Figures 3, 4:
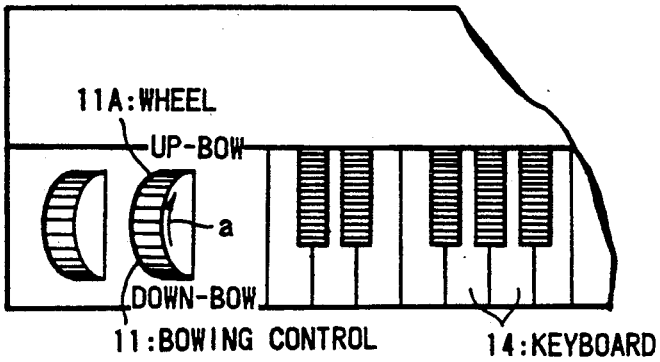
FIG. 3 is a view showing a diagrammatical construction of a bowing control shown in FIG. 1.
FIG. 4 shows a table indicating address control conditions to be used in the first embodiment.

The bowing control 11 is constructed by the potentiometer which is varied by operating a wheel 11A. As shown in FIG. 3, on the same surface of operation panel where the keyboard 14 is provided, the wheel 11A is arranged at the left position of the keyboard 14 in such a manner than almost half portion of the wheel 11A is projected from the surface. For example, the modulation wheel can be employed as the wheel 11A.

The wheel 11A can be revolved in direction "a" or its reverse direction. Therefore, when the operator (or performer) revolves the wheel 11A in direction "a" by his finger of left hand, the present electronic musical instrument inputs the bowing operation information indicating that an up-bow operation mode is selected, wherein this up-bow operation mode corresponds to the up-bow of the string bowing instrument. On the other hand, when the wheel 11A is revolved in the reverse direction of direction "a", the present electronic musical instrument inputs the bowing operation information indicating that a down-bow operation mode is selected, wherein this down-bow operation mode corresponds to the down-bow of the string bowing instrument.

The operating direction detecting circuit 12 repeatedly scans operating position data obtained from the potentiometer by the predetermined period. Then, by comparing the current operating position data with the preceding operating position data which is obtained before scanning, the operating direction detecting circuit 12 detects that the bowing control 11 is operated in either up-bow direction or down-bow direction.

Herein, the present embodiment is designed to store several detection results (e.g., ten detection results) indicating the previous bowing operations. Then, the present embodiment selects the bowing operation mode corresponding to the bowing direction which is emerged more frequently than other bowing direction within the previous bowing directions. Thus, the precision can be raised in selecting the suitable bowing operation mode.

Meanwhile, if the bowing control 11 is in the non-operating state, the operating direction detecting circuit 12 outputs the operating direction detecting signal FWD corresponding to the predetermined one of up-bow and down-bow directions.

In both bowing operation modes, the revolution speed of the wheel 11A corresponds to the operating speed of the bowing operation. Then, the information indicative of this revolving speed is converted into the operating speed detecting signal SP by the operating speed detecting circuit 13.

The operating speed detecting circuit 13 calculates the difference between the current position data and preceding position data based on the periodically scanned operating position data. Then, the calculated difference is computed into the operating speed.

The operating direction detecting signal FWD is supplied to a start address memory 21 and an end address memory 22 as address selecting information.

The start address memory 21 and end address memory 22 are used to generate address information by which the desirable waveform data corresponding to the performance information designated by the performer is selectively read out from all waveform data stored in the waveform memory 6. As shown in FIG. 4, these memories 21, 22 can designate a start address indicative of reading start position and an end address indicative of reading end position when reading out each of the waveform data WA, WB, . . . , WN with respect to each of the tone colors A, B, . . . , N.

As shown in FIG. 4, the start address and end address in either up-bow operation and down-bow operation are selectively determined based on logical level of a waveform data reading state detecting signal ST outputted from a waveform data reading state detecting circuit 23, which will be described later in detail. Herein, the signal ST at "1" level indicates the mode where the waveform data corresponding to the attack portion of the string bowing instrument tone waveform is once read out, while the signal ST at "0" level indicates another mode where the waveform data corresponding to the repeat portion (or stable portion) of the string bowing instrument tone waveform is repeatedly read out.

Figure 2B:
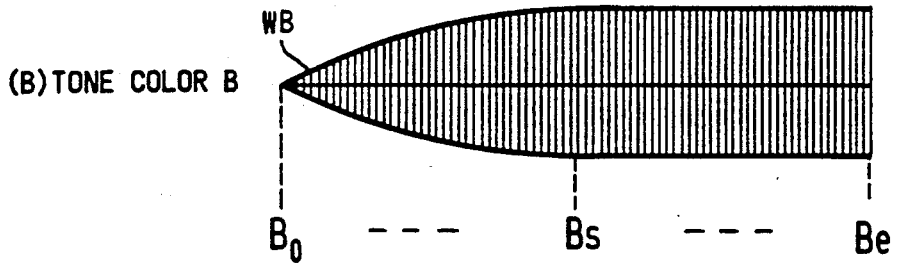
Figure 2C:
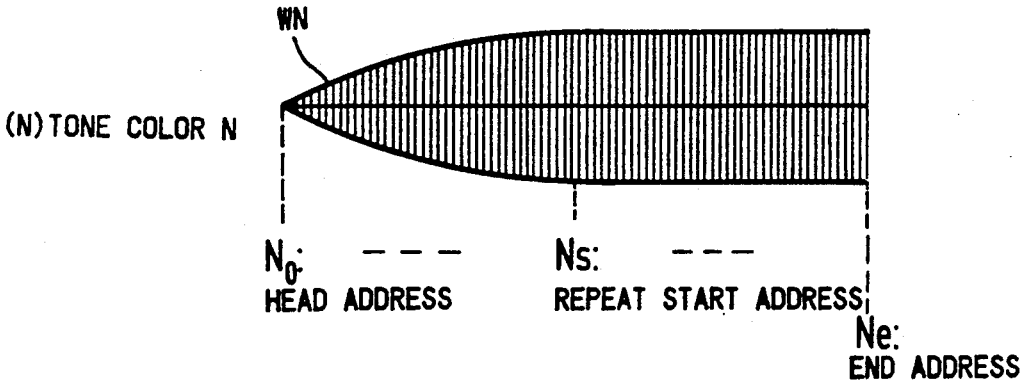

More specifically, when the waveform data reading state detecting signal ST is at "1" level (i.e., ST="1"), in both of the up-bow operation (i.e., FWD="1") and down-bow operation (i.e., FWD="0"), the head addresses Ao, Bo, . . . , No and end addresses Ae, Be, . . . , Ne are designated with respect to the tone colors A, B, . . . , N respectively. Then, each of the waveform data WA, WB, . . . , WN is once read from the waveform memory 6, wherein such waveform data is stored at the memory area designated by the addresses between the above-mentioned head address and end address. In short, both of the attack waveform data D1 and repeat waveform data D2 (see FIG. 2) are once read out with respect to each tone color.

In contrast, when the waveform data reading state detecting signal ST is at "0" (i.e., ST="0"), in the up-bow operation (i.e., FWD="1"), the repeat start addresses As, Bs, . . . , Ns are designated as the start addresses and the end addresses Ae, Be, . . . , Ne are designated as the end addresses with respect to the tone colors A, B, . . . , N respectively. Thus, the waveform data indicative of the repeat portion of each of the waveform data WA, WB, . . . , WN is repeatedly read from the waveform memory 6, wherein this waveform data is stored at the memory are designated by the addresses between the above-mentioned repeat start address and end address. In short, the repeat waveform data D2 (see FIG. 2) is repeatedly read out with respect to each tone color.

On the other hand, when ST="0" in the down-bow operation (i.e., FWD="0"), the end addresses Ae, Be, . . . , Ne are designated as the start addresses and repeat start addresses As, Bs, . . . , Ns are designated as the end addresses with respect to the tone colors A, B, . . . , N respectively. Then, the waveform data designated by the addresses between the above-mentioned start address and end address is repeatedly read from the waveform memory 6. Thus, the repeat waveform data D2 is repeatedly read out in its reverse direction.

Actually, the start address memory 21 and end address memory 22 store address data as shown in FIG. 4 with respect to each tone color. When one of the tone colors A, B, . . . , N is designated by a tone color selecting signal TC which is outputted from a tone color selecting circuit 24 by the selecting operation of the performer, the start address designated by the waveform data reading state detecting signal ST and operating direction detecting signal FWD is read from the start address memory 21 as start address data $DATA_{STR}$, which is then supplied to preset data input terminal DATA of the address counter 5. In addition, the end address designated by ST and FWD is read from the end address memory 22 as end address data $DATA_{END}$, which is then supplied to first terminal B of an end address coincidence detecting circuit 25.

Further, the address signal ADR outputted from the address counter 5 is supplied to second terminal A of the end address coincidence detecting circuit 25. When this address signal ADR coincides with the end address data $DATA_{END}$, the end address coincidence detecting circuit 25 outputs a coincidence detecting signal EQ to the waveform data reading state detecting circuit 23 as an inverted trigger signal.

The waveform data reading state detecting circuit 23 is constructed by R-S flip-flop, for example. When the key-on pulse signal KONP is fed to a set input S, this flip-flop is set so that the waveform data reading state detecting circuit 23 outputs the waveform data reading state detecting signal ST having the logical level "1". In such state, when the coincidence detecting signal EQ is generated and then fed to reset input R of the flip-flop, the flip-flop is inverted so that the logical level of the waveform data reading state detecting signal ST is inverted from "1" to "0".

As described above, when any key-depression is detected in the keyboard circuit 2, the waveform data reading state detecting signal ST at the logical level "1" is supplied to both of the start address memory 21 and end address memory 22. Until the coincidence detecting signal EQ is generated from the end address coincidence detecting circuit 25, the waveform data at the tone-generation start timing is read out based on the addresses as shown in column "ST=1" in FIG. 4.

When the coincidence detecting signal EQ is generated, the logical level of the waveform data reading state detecting signal ST is changed over to "0" level. Thus, under operation of the waveform data reading state detecting circuit 23, the waveform data at the tone-generation repeat timing is read out based on the addresses as shown in column "ST=0" in FIG. 4.

The operating direction detecting signal FW obtained from the operating direction detecting circuit 12 is supplied to up/down input terminal UD of the address counter 5 via an up/down designating circuit 26.

The up/down designating circuit 26 provides a selector 26A which receives the waveform data reading state detecting signal ST as its selecting signal. When the waveform data reading state detecting signal ST is at "0" level, this signal ST is directly supplied to selection terminal SA of the selector 26A so that "0" signal is supplied to selection terminal SA. In addition, the signal ST at "0" level is inverted by an inverter 26B and then supplied to another selection terminal SB of the selector 26A so that "1" signal is supplied to selection terminal SB. In this state, the selector 26A selects the operating direction detecting signal FW inputted to its terminal B, so that this selected signal FWD is supplied to up/down input terminal UD of the address counter 5 as an up/down designating signal UD.

As described above, in the state where the waveform data reading state detecting signal ST is at "0" level (i.e., under the condition where ST="0" as shown in FIG. 4), when the operating direction detecting signal FWD is at "1" level, an up-count mode is designated such that the address counter 5 carries out an up-count operation. On the other hand, when the signal FWD is at "0" level, a down-count mode is designated such that the address counter 5 carries out a down-count operation.

In contrast, in the state where the waveform data reading state detecting signal ST is at "1" level (i.e., under the condition where ST="1" as shown in FIG. 4), the selector 26A selects and then sends out "1" signal supplied to its terminal A as the up/down designating signal UD. Thus, regardless of the logical level of the signal FWD, the address counter 5 is controlled to carry out the up-count operation.

The key-on pulse KONP and coincidence detecting signal EQ are passed through an OR circuit 27 and then supplied to preset input terminal PR of the address counter 5 as a present signal. Therefore, when any key is depressed so that the key-on pulse signal KONP is generated, the address counter 5 is set in the preset state so that the start address data $DATA_{STR}$ is preset into the address counter 5. The address count operation is started to be carried out with respect to the musical tone at the tone-generation start timing. In addition, when the coincidence detecting signal EQ is obtained thereafter, the address counter 5 is preset again by this signal EQ, by which the data of the address counter 5 is forced to be replaced by the start address data $DATA_{STR}$. Thus, the address count operation is started to be carried out with respect to the musical tone at the repeat-tone-generation timing.

The tone color control circuit 7 is supplied with filter coefficient data FILT which is generated by a filter coefficient generating circuit 31 based on the tone color selecting signal TC, waveform data reading state detecting signal ST and operating speed detecting signal SP. Thus, under control of the filter coefficient data FILT, the tone color of the musical tone waveform signal DW1 read from the waveform memory 6 is controlled to be corresponding to the tone color which is designated based on the combination of the tone color selecting signal TC, waveform data reading state detecting signal ST and operating speed detecting signal SP.

Further, the envelope applying circuit 8 is supplied with an envelope signal ENV which is generated by an envelope signal generating circuit 32 based on the key-on signal KON, tone color selecting signal TC and operating speed detecting signal SP (and the key code signal KC). Thus, the desirable envelope designated by the envelope signal ENV is applied to the musical tone waveform signal DW2 obtained from the tone color control circuit 7.

(2) Operation of First Embodiment

Next, description will be given with respect to the operation of the first embodiment.

In this embodiment, the performer operates the wheel 11A of the bowing control 11 in direction "a" (corresponding to up-bow direction) or its reverse direction (corresponding to down-bow direction) while performing the keyboard 14 (shown in FIG. 3).

Every time the key-on operation is carried out in the keyboard circuit 2, the key-depression detecting circuit 3 generates the key-on pulse signal KONP, by which the waveform data reading state detecting circuit 23 is set so that the logical level of the waveform data reading state detecting signal ST is changed over to "1" level.

At the same time, when the wheel 11A of the bowing control 11 is revolved in direction "a" so that the up-bow operation is carried out, the operating direction detecting circuit 12 delivers the operating direction detecting signal FWD at "1" level. In addition, the operating speed detecting circuit 13 delivers the operating speed detecting signal SP corresponding to the operating speed (i.e., revolving speed) of the wheel 11A of the bowing control 11.

In this state, the waveform data reading state detecting signal ST is at "1" (i.e., ST="1"), so that the up/-down designating circuit 26 selects and then outputs the "1" signal to the address counter 5 as the up/down designating signal UD. Due to this "1" signal, the address counter 5 is set in the up-count operating state.

Further, the key-on pulse signal KONP is supplied to preset input terminal PR of the address counter 5 via the OR circuit 27, by which the start address data $DATA_{STR}$ is preset to the address counter 5. Since the waveform data reading state detecting signal ST is at "1", the start address memory 21 selects the address data of the tone-generation starting portion as indicated in column "ST=1" of FIG. 4. Then, the address data corresponding to the tone color designated by the performer (e.g., tone color A) are extracted from all of the selected address data. Further, desirable start address is selected based on the operating direction detecting signal FWD. For example, in case of ST="1", FWD="1" of tone color A, the start address Ao is selected in the up-bow operation. In this case, this start address Ao is preset as the start address data $DATA_{STR}$.

Figure 5:
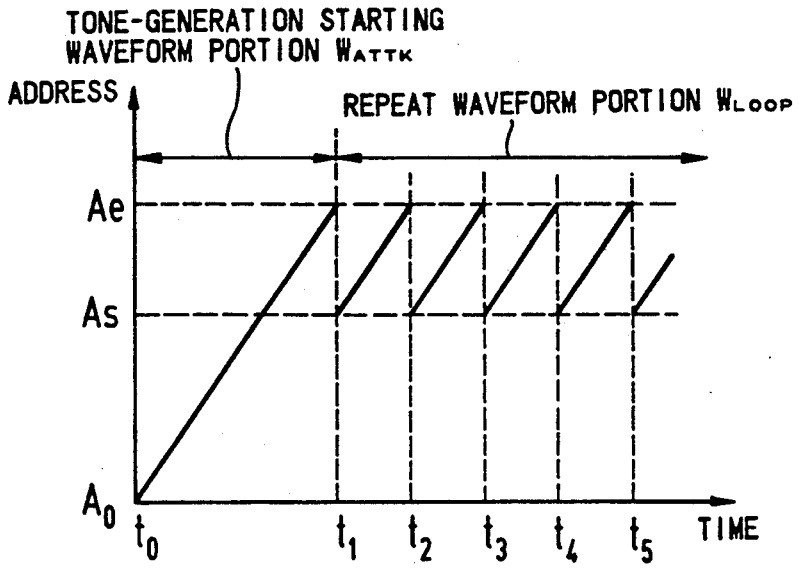
FIGS. 5 to 7 are graphs which are used to explain address control operations of the first embodiment.

Meanwhile, the note clock generating circuit 4 delivers the note clock signal NOTE having the frequency corresponding to the key depressed by the performer, and then this note clock signal NOTE is supplied to the address counter 5. Thus, the address counter 5 starts to carry out the up-count operation from the preset start address Ao by the speed corresponding to the pitch of the key depressed by the performer. As a result, the address counter 5 supplies the address signal ADR to the waveform memory 6, wherein this address signal ADR has the address which is incremented from the start address Ao. Thus, as shown in FIG. 5, the waveform data WA of the tone color A (see FIG. 2(A)) are sequentially read from the waveform memory at the addresses from head address Ao to end address Ae. As a result, the waveform memory 6 outputs the musical tone waveform signal DW1 of the tone-generation starting waveform portion (i.e., attack waveform portion) $W_{ATTK}$.

In this state, the same selecting conditions given to the start address memory 21 are also given to the end address memory 22, so that end address Ae shown in FIG. 4 is read out as the end address data $DATA_{END}$. Then, the end address coincidence detecting circuit 25 compares the address signal ADR from the address counter 5 with the end address data $DATA_{END}$. In other words, the present system is set in the monitoring state wherein it is judged whether or not ADR coincides with $DATA_{END}$.

Thereafter, the end address coincidence detecting circuit 25 will generate the coincidence detecting signal EQ, indicating that the waveform data WA have been once read out from head address Ao to end address Ae. At this time, the coincidence detecting signal EQ resets the waveform data reading state detecting circuit 23, so that the logical level of the waveform data reading state detecting signal ST is changed over from "1" to "0".

Then, the start address data and end address data of the address counter 5 are changed over from those shown in column "ST=1" to those shown in column "ST=0" of FIG. 4.

More specifically, as shown in column "ST=0" and "FWD=1" of FIG. 4, repeat start address As and end address Ae are respectively read from the start address memory 21 and end address memory 22 as the start address data $DATA_{STR}$ and end address data $DATA_{END}$.

At this time, the coincidence detecting signal EQ is supplied to present input terminal PR of the address counter 5, so that the address counter 5 presets the start address data $DATA_{STR}$(=As). Then, the address counter 5 continues to carry out the up-count operation from address As by the note clock signal NOTE.

Therefore, as shown in FIG. 5, the reading address of reading out the waveform data WA is returned from end address Ae to repeat start address As at time t1 when the coincidence detecting signal EQ is generated, and then such reading address is incremented to end address Ae.

At next time t2, the address signal ADR corresponding to the count value of the address counter 5 coincides with the end address data $DATA_{END}$(=Ae) so that the end address coincidence detecting circuit 25 outputs the coincidence detecting signal EQ again. This signal EQ presets the address counter 5, and this signal EQ also functions to reset the waveform data reading state detecting circuit 23.

However, the waveform data reading state detecting circuit 23 has been already set in the reset state. Therefore, the above-mentioned signal EQ cannot function to further reset the waveform data reading state detecting circuit 23. For this reason, the logical level of the waveform data reading state detecting signal ST is not varied by the signal EQ but remained as ST=0".

Therefore, the start address data $DATA_{STR}$ read from the start address memory 21 is not changed at time t2, so that $DATA_{STR}$=As is remained. Thus, the address counter 5 repeats to carry out the up-count operation from repeat start address As again.

In short, from time t2 to t3, the waveform data WA from repeat start address As to end address Ae are sequentially and repeatedly read from the waveform memory 6.

Thereafter, at each of times t3, t4, etc. when the end address coincidence detecting circuit 25 detects the end address coincidence event, the above-mentioned operations which are carried out on the address counter 5, start address memory 21 and end address memory 22 at time t2 are carried out again. Therefore, the waveform data WA from repeat start address As to end address Ae are repeatedly read from the waveform memory 6. As a result, the musical tone waveform signal DW1 of repeat waveform portion $W_{LOOP}$ (see FIG. 5) are read from the waveform memory 6.

As described heretofore, while the bowing control 11 is operated in the up-bow direction, the waveform data WA from head address Ao to end address Ae is once read out and then its succeeding waveform data WA from repeat start address As to end address Ae is repeatedly read out from the waveform memory 6, so that it is possible to generate the string bowing instrument tones in up-bow operation.

Then, the musical tone waveform signal DW1 read from the waveform memory 6 is controlled in its tone color based on the filter coefficient data FILT generated by the filter coefficient generating circuit 31 in the tone color control circuit 7.

More specifically, when the current tone color selecting signal TC selects the tone color A, the filter coefficient generating circuit 31 selects a group of filter coefficient data corresponding to the tone color A, from which the filter coefficient data corresponding to the waveform data reading state detecting signal ST (i.e., ST="1") is further selected. The finally selected filter coefficient is converted to the filter coefficient data FILT by the operating speed detecting signal SP, and then this data FILT is delivered to the tone color control circuit 7.

Thus, the tone color of the musical tone waveform signal DW2 outputted from the tone color control circuit 7 is slightly varied in the tone-generation starting waveform portion $W_{ATTK}$ and its succeeding repeat waveform portion $W_{LOOP}$. In addition, the musical tone waveform signal DW2 is controlled to have the tone color corresponding to the operating speed of the bowing control 11.

In the first embodiment, the tone color control circuit 7 is controlled such that the cut-off frequency becomes higher as the operating speed becomes faster, in other words, the cut-off frequency becomes lower as the operating speed becomes slower.

As described before, the envelope applying circuit 8 applies the envelope to the musical tone waveform signal DW2 outputted from the tone color control circuit 7. Herein, based on the key-on signal KON, the envelope signal generating circuit 32 continues to generate the envelope control signal ENV between the key-on timing and key-release timing. Based on the tone color selecting signal TC and operating speed detecting signal SP, the envelope representative of the waveform from its attack portion to decay portion is changed over in response to the selected tone color and the operating speed of up-bow or down-bow operation.

Above is the description of explaining the operation of first embodiment when the bowing control 11 is operated in up-bow direction. In contrast, when the performer operates the bowing control 11 by his left hand in the reverse direction of direction "a" while performing the keyboard 14 by his right hand, the operating direction detecting circuit 12 outputs the operating direction detecting signal FWD at "0" level.

In such state, when the performer carries out the key-on operation, the address counter 5 is preset by the key-on pulse signal KONP. In addition, the waveform data reading state detecting circuit 23 is subject to the set state so that the waveform data reading state detecting signal ST is set at "1" level (i.e., ST="1"). Thus, as shown in column "ST=1" of FIG. 4 which is described in the foregoing up-bow operation, head address Ao and end address Ae are respectively read from the start address memory 21 and end address memory 22 as the start address data $DATA_{STR}$ and end address data $DATA_{END}$ at time t0 shown in FIG. 6.

Therefore, while the address counter 5 carries out the up-count operation from the preset head address Ao to end address Ae at one time, the corresponding waveform data WA are sequentially read from the waveform memory 6 once.

Thereafter, when the address signal ADR coincides with end address Ae, the end address coincidence detecting circuit 25 generates the coincidence detecting signal EQ so that the waveform data reading state detecting circuit 23 inverts the logical level of its output signal ST. Thus, as shown in column "ST=0" and "FWD=0" of FIG. 4, end address Ae is read from the start address memory 21 as the start address data $DATA_{STR}$ so that end address Ae is preset to the address counter 5, while repeat start address As is read from the end address memory 22 as the end address data $DATA_{END}$.

At this time, the up/down designating circuit 26 selects and then outputs the operating direction detecting signal FWD at "0" level to up/down designating input terminal UD of the address counter 5, so that the address counter 5 carries out the down-count operation.

Therefore, at time t11 (shown in FIG. 6) when the coincidence detecting signal EQ is obtained, the waveform data WA are read from the waveform memory 6 from end address Ae to repeat start address As.

At time t12 when the address signal ADR coincides with the end address data $DATA_{END}$(=As) so that the end address coincidence detecting circuit 25 outputs the coincidence detecting signal EQ, the address counter 5 presets end address Ae as the start address data $DATA_{STR}$ again. Thereafter, the waveform data WA is repeatedly read from the waveform memory 6 from end address Ae to repeat start address As.

Figure 6:
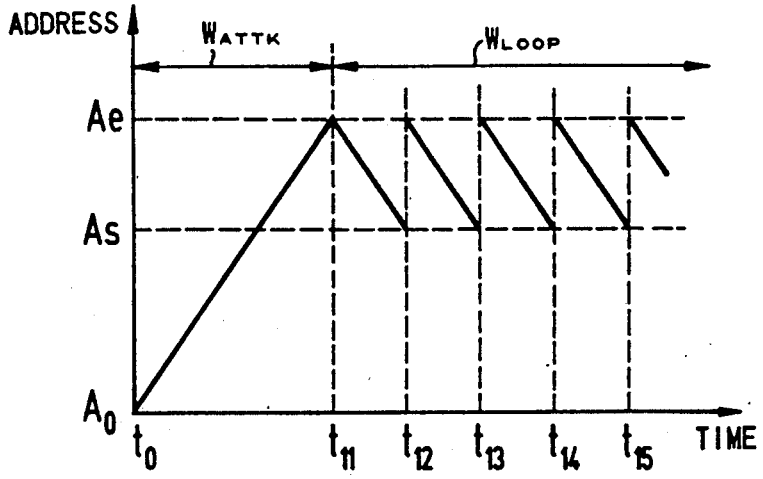

As described above, in the case where the performer operates the bowing control 11 in the down-bow direction, the waveform data WA is once read from the waveform memory 6 from head address Ao to end address Ae at times t0 -t11 as shown in FIG. 6. Thereafter, the waveform data WA from end address to repeat start address is repeatedly read from the waveform memory 6.

Incidentally, both of the musical tones generated in the up-bow operation and down-bow operation are similarly represented by the repeat waveform portion $W_{LOOP}$ which is obtained by reading out the waveform data between repeat start address As and end address Ae. Therefore, there is no difference between the frequency spectrums included in the musical tone waveforms generated in up-bow and down-bow operations. In contrast, the tone colors are slightly different from each other in the up-bow and down-bow operations. As a result, the present electronic musical instrument according to the first embodiment can simulate the string bowing instrument tone sounded from non-electronic string bowing instrument.

Figure 7:
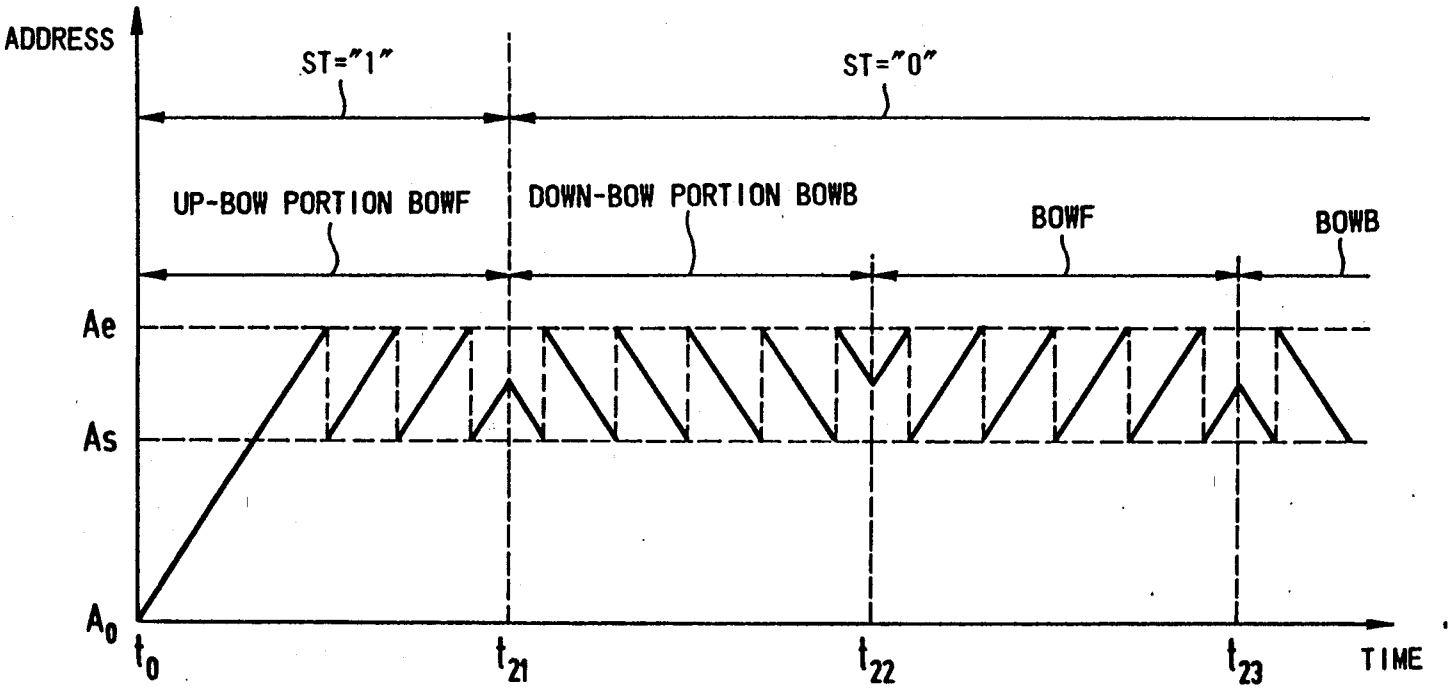

The above description concerning FIGS. 5 and 6 relates to the operation of the first embodiment wherein either up-bow operation or down-bow operation is carried out by operating the bowing control 11 when the performer carries out one key-on operation. However, it is possible to operate the bowing control 11 as shown in FIG. 7. More specifically, when the performer carries out the key-on operation at time t0, the performer also carries out the up-bow operation during up-bow period BOWF. At time t21, the performer starts to carry out the down-bow operation during down-bow period BOWB. Then, at time t22, the performer changes over his bowing operation from down-bow operation to up-bow operation. Similarly, thereafter, the up-bow operation and down-bow operation are alternatively selected. In such case where the performance is carried out by alternatively changing over the up-bow operation and down-bow operation, the logical level of the operating direction detecting signal FWD is changed over every time the operation direction of the bowing control 11 is changed over. Thus, every time the operating direction of the bowing control 11 is changed over, only the repeat waveform portion $W_{LOOPS}$ is changed over.

More specifically, when the performer operates the bowing control 11 in up-bow direction at time t0, the address counter 5 operates as described before in conjunction with FIG. 5, wherein the waveform data from head address Ao to end address Ae is read out so that the tone-generation starting waveform portion $W_{ATTK}$ is to be formed. Then, the waveform data from repeat start address As to end address Ae is repeatedly read out so that the repeat waveform portion $W_{LOOP}$ is to be formed.

After carrying out the up-bow operation during up-bow period BOWF between times t0–t21 of FIG. 7, when the performer changes over the bowing direction of the bowing control 11 to the down-bow direction, the logical level of the operating direction detecting signal FWD is changed from "1"to "0". In synchronism with the above-mentioned change in the logical level of the signal FWD, the start address data $DATA_{STR}$ read from the start address memory 21 is changed over from repeat start address As to end address Ae, while the end address data $DATA_{END}$ read from the end address memory 22 is changed over from end address Ae to repeat start address As.

At the same time, when the logical level of the operating direction detecting signal FWD is changed over from "1" to "0", the logical level of the up/down designating signal UD is changed over from "1" to "0" so that the count operation of the address counter 5 is changed over to the down-count operation.

Therefore, the present system enters into the down-bow period BOWB at time t21 shown in FIG. 7, wherein the waveform data WA is to be read out from end address Ae to repeat start address As.

Then, when the bowing direction of the bowing control 11 is changed over to up-bow direction again after carrying out the down-bow operation during down-bow period BOWB, the logical level of the operating direction detecting signal FWD is changed over from "0" to "1" so that the count operation of the address counter 5 is changed over to up-count operation. In addition, the start address data $DATA_{STR}$ in the start address memory 21 is changed over from end address Ae to repeat start address As, while the end address data $DATA_{END}$ in the end address memory 22 is changed over from repeat start address As to end address Ae.

Thus, the operational period of the waveform memory 6 is returned back to the up-bow period BOWF again after time t22.

Similarly, thereafter, every time the performer alternatively carries out either the up-bow operation or down-bow operation on the bowing control 11, the operation period of the waveform memory 6 is alternatively set to either up-bow period BOWF or down-bow period BOWB.

Incidentally, the operations described heretofore concern with the tone color A. However, it is possible to carry out the similar operations with respect to other tone colors, i.e., tone colors B to N.

As similar to the case where the performer plays the string bowing instrument such as the violin with bow which is moved up and down, the present electronic musical instrument can generate the string bowing instrument tones whose tone colors can be slightly varied by carrying out the bowing operation of the bowing control 11.

Moreover, the filter characteristic in the tone color control circuit 7 can be controlled by controlling the operating speed of the bowing control 11. Thus, the present electronic musical instrument can offer the delicate tone color variation quite similar to the tone color variation which is generated by varying the bowing speed of the bow of violin, for example.

[C] SECOND EMBODIMENT

(1) Configuration of Second Embodiment

Next, description will be given with respect to the second embodiment of the present invention by referring to FIG. 8 etc., wherein parts identical to those in FIG. 1 are designated by the same numerals, hence, description thereof will be omitted.

In the second embodiment shown in FIG. 8, the key code signal KC outputted from the key-depression detecting circuit 3 is supplied to a frequency information memory 41 wherein frequency information FNO (i.e., so-called F-number) is generated in response to the note name indicated by the key code signal KC. This frequency information FNO is supplied to an accumulator 42.

The accumulator 42 accumulates the unit data of the above-mentioned frequency information FNO by every predetermined period, and then its accumulation result is supplied to an adder 43 as increment address signal ADRX. Incidentally, the key-on pulse signal KONP and coincidence detecting signal EQ are supplied to reset terminal R of the accumulator 42 via an OR circuit 42A. Therefore, the accumulator 42 is reset by these signals KONP and EQ.

Meanwhile, start address data $DATA_{STRX}$ obtained from a start address memory 21X is supplied to the adder 43 as the data indicative of the address start point. Thus, the adder 43 adds the start address data $DATA_{STRX}$ and increment address signal ADRX together, by which the addition result is obtained as the address signal ADR for reading out the waveform data from the waveform memory 6.

In the second embodiment, the operating direction detecting circuit 12 detects and operating direction of the bowing control 11 to thereby generate the operating direction detecting signal FWD, which is then supplied to a latch circuit 45. Herein, the key-on pulse signal KONP and coincidence detecting signal EQ are supplied to this latch circuit 45 via an OR circuit 44 as a latch signal. Then, the latch circuit 45 outputs an operating direction detecting signal FWD1 representative of address data designating information, which is supplied to both of the start address memory 21X and an end address memory 22X.

In advance, the start address memory 21X and end address memory 22X pre-stores the address data as the selecting information as shown in FIG. 9 (which corresponds to FIG. 4 of the first embodiment).

Figure 10A:
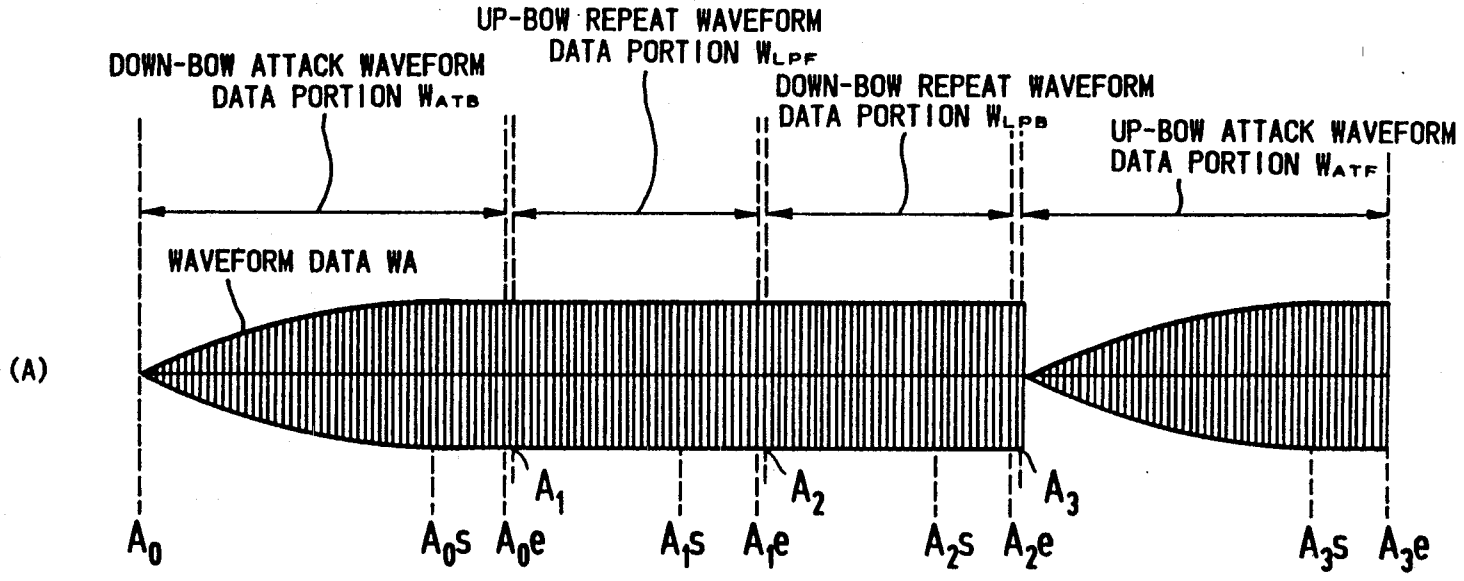
FIG. 10 shows waveforms indicated by waveform data stored in a waveform memory shown in FIG. 8.
Figure 10B:
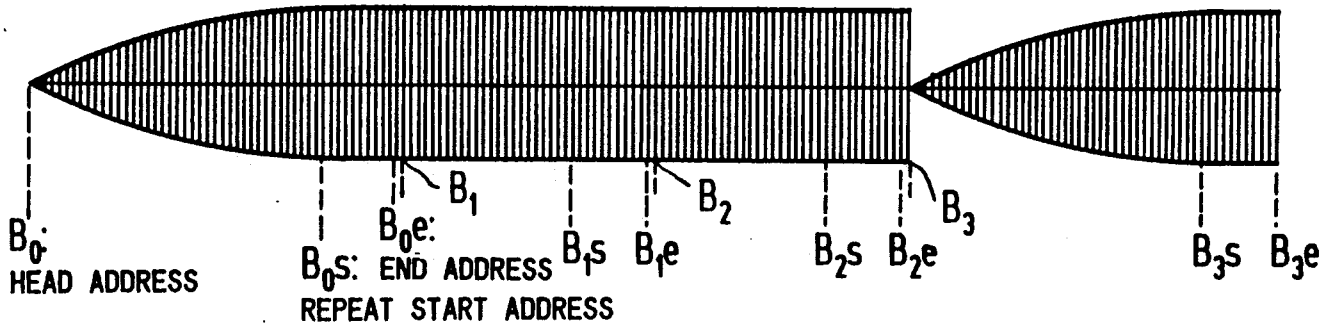
Figure 10C:
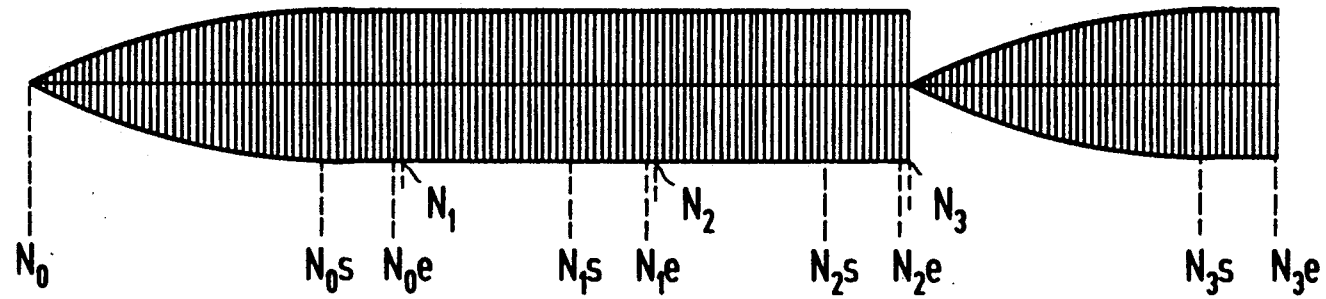

As shown in FIG. 10, each of the waveform data WA-WN of the tone colors A-N includes down-bow tone-generation start waveform data portion (i.e., down-bow attack waveform data portion) $W_{ATB}$, up-bow repeat waveform data portion $W_{LPF}$, down-bow repeat waveform data portion $W_{LPB}$ and up-bow tone-generation start waveform data portion (i.e., up-bow attack waveform data portion) $W_{ATF}$.

The waveform data in the down-bow attack waveform data portions $W_{ATB}$ of the tone colors A, B, . . . , N are stored at the addresses including head addresses Ao, Bo, . . . , No, repeat start addresses Aos, Bos, . . . , Nos and end addresses Aoe, Boe, . . . , Noe respectively.

In addition, the waveform data in the up-bow repeat waveform data portion $W_{LPF}$ of the tone colors A, B, . . . , N are stored at the addresses including head addresses A1, B1 . . . , N1, repeat start addresses A1s, B1s, . . . , N1s and end addresses A1e, B1e, . . . , N1e respectively.

Further, the waveform data in the down-bow repeat waveform data portion $W_{LPB}$ of the tone colors A, B, . . . , N are stored at the addresses including head addresses A2, B2, . . . , N2, repeat start addresses A2s, B2s, . . . , N2s and end addresses A2e, B2e, . . . , N2e.

Furthermore, the waveform data in the up-bow attack waveform data portion $W_{ATF}$ of the tone colors A, B, . . . , N are stored at the addresses including head addresses A3, B3, . . . , N3, repeat start addresses A3s, B3s, . . . , N3s and end addresses A3e, B3e, . . . , N3e.

Therefore, in order to read out the up-bow attack waveform (or down-bow attack waveform) in the state where the tone color A is selected from the tone colors A, B, . . . , N, the present system designates the head address A3 (or Ao) of the up-bow attack waveform data portion $W_{ATF}$ (or down-bow attack waveform data portion $W_{ATB}$); the waveform data are once read out through the repeat start address A3s (or Aos) to the end address A3e (or Aoe) in accordance with the incrementing operation of the increment address signal ADRX; then the present system designates the repeat start address A3s (or Aos) so that the waveform data from the repeat start address A3s (or Aos) to the end address A3e (or Aoe) is repeatedly read out.

In order to form the down-bow repeat waveform (or up-bow repeat waveform) in succession to the formation of the up-bow attack waveform (or down-bow attack waveform) as described above, the present system designates the head address A2 (or A1) of the down-bow repeat waveform data portion $W_{LPB}$ (or up-bow repeat waveform data portion $W_{LTF}$) and then the reading address passes through the repeat start address A2s (or A1s) to the end address A2e (or Ale) by the increment address signal ADRX so that the waveform data from the head address to the end address is once read out; thereafter, the reading address returns back to the repeat start address A2e (or Ale) so that the waveform data from the repeat start address to the end address A2e (or Ale) is repeatedly read out.

The above-mentioned reading process can be achieved by the operation of the waveform data reading state detecting circuit 46. The waveform data reading state detecting circuit 46 provides a R-S flip-flop circuit 46A which receives the key-on pulse signal KONP at its set input S. When this flip-flop circuit 46A is set by the key-on pulse signal KONP, it generates the waveform data reading state detecting signal ST at "1" level.

In addition, the waveform data reading state detecting circuit 46 provides latch circuits 46B, 46C coupled by cascade connection which receives the operating direction detecting signal FWD. Then, an exclusive OR circuit 46D inputs both of output signals FWD2, FWD3 outputted from the latch circuits 46B, 46C respectively. The output of this exclusive OR circuit 46D is delivered to reset input of the R-S flip-flop circuit 46A.

Meanwhile, the key-on pulse signal KONP and the coincidence detecting signal EQ are supplied to an OR circuit 46E, whose output is supplied to latch input of the latch circuit 46B. On the other hand, the coincidence detecting signal EQ is directly supplied to latch input of the latch circuit 46C.

Therefore, when the keyboard circuit 2 detects that any key is depressed in the keyboard 14, the logical level of the operating direction detecting signal FW (indicating the operating direction of the bowing control 11 at the key-depression timing) is latched by the latch circuit 46B. Thereafter, every time the coincidence detecting signal EQ is obtained, the latch circuit 46B repeatedly latches the operating direction detecting signal FWD.

Thus, in the state where the performer carries out the key-on operation so that the up-bow attack waveform data portion $W_{ATF}$ (or down-bow attack waveform data portion $W_{ATB}$) (shown in FIG. 10) is to be formed in response to the operation of the bowing control 11, the latch circuit 46B sends out the latch output FWD2 indicative of the bowing direction of the bowing control 11 operated by the performer. In such state, when the end address of the up-bow attack waveform data portion $W_{ATF}$ (or down-bow attack waveform data portion $W_{ATB}$) is read out so that the coincidence detecting signal EQ is generated. At this timing when the coincidence detecting signal EQ is generated, the latch circuit 46B carries out the latch operation so that the latch circuit 46B outputs the latch output FWD2 indicating the state of the operating direction detecting signal FWD at this timing.

On the other hand, the latch circuit 46C latches the latch output FWD2 of the latch circuit 46B by the coincidence detecting signal EQ which is generated when the end address is read out. Thus, the latch circuit 46C generates its latch output FWD3 corresponding to the latch output FWD2 latched therein. By comparing these two latch outputs FWD2, FWD3 in the exclusive OR circuit 46D, the exclusive OR circuit 46D outputs a reset signal RST having "L" level when the logical level of the operating direction detecting signal FWD is not varied at the timing when the coincidence detecting signal EQ is generated (in other words, when the performer does not change the bowing direction of the bowing control 11). This reset signal RST is delivered to reset input of the flip-flop circuit 46A. However, since the reset signal RST is at "L" level, the flip-flop circuit 46A is not subject to the inverting operation.

In contrast, when the logical level of the operating direction detecting signal FW is varied at the timing when the coincidence detecting signal EQ is generated (i.e., when the performer changes over the operating direction of the bowing control 11), the latch output FWD2 does not coincide with the latch output FWD3 in the logical level, so that the exclusive OR circuit 46D outputs the reset signal RST having "H" level. Thus, at the leading edge timing of the reset signal RST, the flip-flop circuit 46A is reset so that the logical level of the waveform data reading state detecting signal ST is changed over from "1" to "0".

As described heretofore, when the operating direction of the bowing control 11 is changed over from up-bow direction to down-bow direction or from down-bow direction to up-bow direction, the waveform data reading state detecting circuit 46 inverts the logical level of the signal ST in response to the change of the operating direction of the bowing control 11.

Herein, the start address data $DATA_{STRX}$ and end address data $DATA_{ENDX}$ respectively read from the start address memory 21X and end address memory 22X are changed over under the control conditions as shown in FIG. 9.

(2) Operation of Second Embodiment

Next, description will be given with respect to the operation of the second embodiment.

First, in the case where the performer selects the tone color A from plural tone colors A-N and then depresses the key while operating the bowing control 11 in up-bow direction, the R-S flip-flop circuit 46A within the waveform data reading state detecting circuit 46 is set at the timing when the key-on pulse signal KONP is generated. At this timing, the waveform data reading state detecting signal ST is set at "1" level, and the latch circuit 45 latches the operating direction detecting signal FWD at "H" level so that the signal FWD1 is set at "1" level.

In the above-mentioned condition, the waveform data of the up-bow attack waveform data portion $W_{ATF}$ is to be selected from all waveform data WA (see FIG. 10). Meanwhile, the key-on pulse signal KONP is supplied to a R-S flip-flop 48 via an OR circuit 47 so that this R-S flip-flop 48 is set. Thus, as shown in column "ST=1" and "FWD1=1" of FIG. 9, head address A3 is read from the start address memory 21X as the start address data $DATA_{STRX}$, while end address A3e is read from the end address memory 22X as the end address data $DATA_{ENDX}$.

Therefore, the waveform data of the up-bow attack waveform data portion $W_{ATF}$ is once read from the waveform memory 6. Then, when the end address coincidence detecting circuit 25 generates the coincidence detecting signal EQ, R-S flip-flop 48 is reset. In this case, head address A3 which is read from the start address memory 21X as the start address data $DATA_{STRX}$ is replaced by repeat start address A3s. Thus, the waveform memory 6 is set in the state where the waveform data from repeat start address A3s to end address A3e within the up-bow attack waveform data portion $W_{ATF}$ is to be read out.

Thereafter, when the end address coincidence detecting circuit 25 generates the coincidence detecting signal EQ, the start address memory 21X and end address memory 22X are set in the state where head address A3s and end address A3e are respectively read out as the start address data $DATA_{STRX}$ and end address data $DATA_{ENDX}$ again. Thus, the waveform data from repeat start address A3s to end address A3e is repeatedly read from the waveform memory 6.

The above-mentioned state will be changed when the performer changes over the bowing direction of the bowing control 11.

More specifically, when the bowing direction is changed so that the logical level of the operating direction detecting signal FWD is changed from "1" to "0", the logical level of the latch output FWD2 of the latch circuit 46B is changed to "0" level, by which the latch output FWD2 does not coincide with the latch output FWD3. Thus, the logical level of the reset signal RST rises up from "0" to "1" so that the R-S flip-flop circuit 46A is set. In addition, such reset signal RST is supplied to set input S of the R-S flip-flop 48 via the OR circuit 47 so that the R-S flip-flop 48 is also set.

As a result, the logical level of the waveform data reading state detecting signal ST is changed over to "0" level. In this case, the address selecting condition corresponds to the data as shown in column "ST=0" and "FWD1=0" of FIG. 9. In this condition, the start address memory 21X is controlled such that head address A2 of the down-bow repeat waveform data portion $W_{LPB}$ (see FIG. 10) is read out as the start address data $DATA_{STRX}$, while the end address memory 22X is controlled such that end address A2e is read out as the end address data $DATA_{ENDX}$.

Thus, the waveform data from head address A2 to end address A2e is to be read from the waveform memory 6.

Thereafter, when the coincidence detecting signal EQ is obtained, the R-S flip-flop 48 is reset. At this time, the start address memory 21X is controlled such that repeat start address A2s is read out as the start address data $DATA_{STRX}$. Thus, the address signal ADR controls the waveform memory 6 such that the waveform data of the down-bow repeat waveform data portion $W_{LPB}$ from repeat start address A2s to end address A2e is to be read out.

Thereafter, when the coincidence detecting signal EQ is obtained again, the R-S flip-flop 48 is reset. However, until the operating direction detecting signal FWD is inverted, the logical level of the operating direction detecting signal FWD1 obtained from the latch circuit 45 is not changed. Therefore, until then, the address reading state of the start address memory 21X and end address memory 22X are maintained in the above-mentioned state wherein the start address data $DATA_{STRX}$ designates repeat start address A2s and the end address data $DATA_{ENDX}$ designates end address A2e.

Thus, while the performer operates the bowing control 11 in down-bow direction, the waveform data from repeat start address A2s to end address A2e is repeatedly read from the waveform memory 6.

Once the waveform data reading state detecting circuit 46 is reset by the reset signal RST after the R-S flip-flop circuit 46A is set by the key-on pulse signal KONP, the logical level of the waveform data reading state detecting signal ST is not inverted when next key-on pulse signal KONP is not supplied to the circuit 46 (i.e., when the performer does not perform new key-depression operation) even if the logical level of the reset signal RST is changed over. Thus, the address selecting condition of the start address memory 21X and end address memory 22X is changed over to that as shown in column "ST=0" of FIG. 9. Thereafter, when the bowing direction of the bowing control 11 is changed so that the operating direction detecting signal FWD1 is changed over, one of the down-bow repeat waveform data portion $W_{LPB}$ and up-bow repeat waveform data portion $W_{LPF}$ are alternatively selected so that the corresponding waveform data is to be read from the waveform memory 6.

Afterwards, when the performer completes the down-bow operation and then starts the up-bow operation of the bowing control 11, the logical level of the operating direction detecting signal FWD is changed over from "0" to "1". Due to the coincidence detecting signal EQ which is generated thereafter, the above-mentioned operating direction detecting signal FWD at "1" level is latched by the latch circuit 45 so that the latch circuit 45 turns the logical level of its latch output FWD1 to "1" level.

At this time, as shown in column "ST=0" and "FWD1=1" of FIG. 9, head address A1 and end address Ale are respectively read from the start address memory 21X and end address memory 22X as the start address data $DATA_{STRX}$ and end address data $DATA_{ENDX}$.

Thus, the waveform data from head address A1 to end address Ale within the waveform data of the up-bow repeat waveform data portion $W_{LPF}$ (see FIG. 10) is once read from the waveform memory 6.

Thereafter, when the coincidence detecting signal EQ is obtained, the R-S flip-flop 48 is reset. In this case, the start address memory 21X is controlled such that repeat start address A1s is read out as the start address data $DATA_{STRX}$ Thus, the address signal ADR designates the addresses, by which the waveform data from repeat start address A1s to end address A1e within the waveform data of the up-bow repeat waveform data portion $W_{LPF}$ is read from the waveform memory 6.

Then, when the coincidence detecting signal EQ is obtained again, the R-S flip-flop 48 is reset again. In this case, until the operating direction detecting signal FWD1 is not varied, the start address memory 21X continues to output repeat start address A1s as the start address data $DATA_{STRX}$. Thus, the waveform memory 6 is controlled such that the waveform data from head address A1s to end address Ale within the waveform data of the up-bow repeat waveform data portion $W_{LPF}$ is repeatedly read out.

The operation described heretofore depends on the case where the bowing control 11 is operated in up-bow direction when the performer depressed the key. On the other hand, if the bowing control 11 is operated in down-bow direction when the performer depresses the key, the address selecting condition of the start address memory 21X and end address memory 22X is designated as shown in column "ST=1" and "FWD1=0" of FIG. 9 when the waveform data reading state detecting signal ST is at "1" level. More specifically, just after the key-on pulse signal KONP is generated, head address Ao and end address Aoe are read out as the start address data $DATA_{STRX}$ and end address data $DATA_{ENDX}$ respectively. Thereafter, every time the coincidence detecting signal EQ is obtained, repeat start address Aos is read from the start address memory 21X as the start address data $DATA_{STRX}$.

Figure 11:
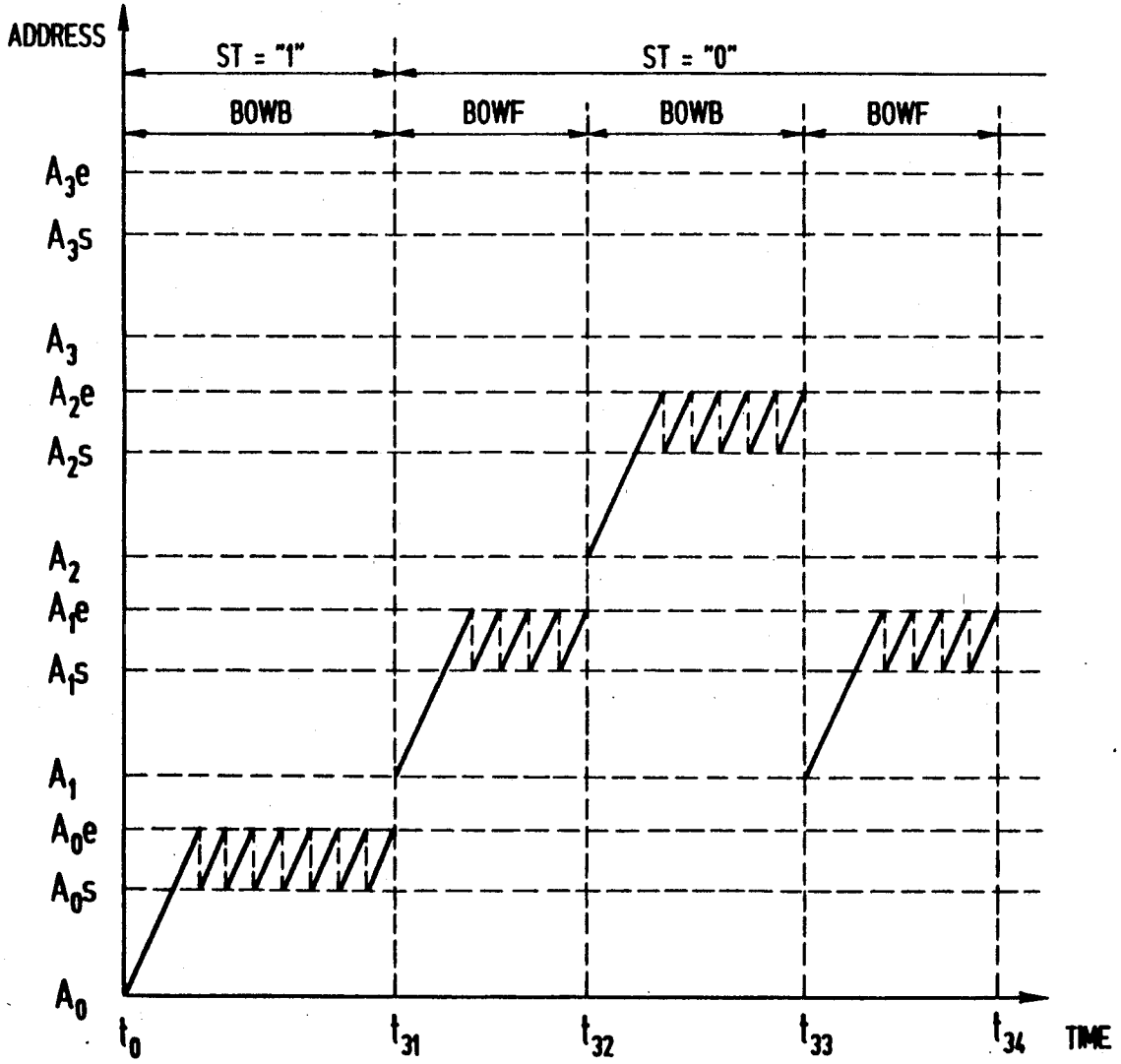
FIG. 11 is a graph which is used to explain an operation of a bowing control shown in FIG. 8.

Now, at time t0 shown in FIG. 11 when the performer depresses the key while operating the bowing control 11 in down-bow direction, the waveform data reading state detecting signal ST is set at "1" (i.e., ST=1) by the key-on pulse signal KONP. In addition, the operating direction detecting signals FWD, FWD1 are both set at "0" (i.e., FWD1=0).

As a result, when selecting the down-bow attack waveform data portion $W_{ATB}$ (see FIG. 10), addresses Ao, Aos are sequentially read from the start address memory 21X as the start address data $DATA_{STRX}$, while address Aoe is read from the end address memory 22X as the end address data $DATA_{ENDX}$.

In FIG. 11, during the down-bow operation period BOWB between times t0, t31, the waveform data from head address Ao to end address Aoe within the waveform data WA of the down-bow attack waveform data portion $W_{ATB}$ is once read out and then the waveform data from repeat start address Aos to end address Aoe is repeatedly read from the waveform memory 6.

As a result, the musical tone forming portion 9 can generate the string bowing instrument tone whose tone color is quite similar to that sounded from the non-electronic string bowing instrument at the tone-generation timing. In other words, the attack waveform of the electronic string bowing instrument tone is controlled to be quite similar to that of the non-electronic string bowing instrument tone.

As described heretofore, when the performer changes over the bowing direction of the bowing control 11 to the up-bow direction after the musical-tone-generation is started, the signal FWD1 is set at "1" level due to the operating direction detecting signal FWD, so that the logical level of the waveform data reading state detecting signal ST is set at "0" (i.e., ST=0).

In this case, the start address memory 21X and end address memory 22X are controlled such that the waveform data of the up-bow repeat waveform data portion $W_{LPF}$ are sequentially read out. Herein, addresses A1, As1 are read out as the start address data $DATA_{STRX}$, while address A1e is read out as the end address data $DATA_{ENDX}$.

As a result, during the up-bow operation period BOWF between times t31, t32 shown in FIG. 11, the waveform data of the up-bow repeat waveform data portion $W_{LPF}$ from head address A1 to end address Ale is once read out and then waveform data from repeat start address A1s to end address A1e is repeatedly read from the waveform memory 6.

Thus, the musical tone forming portion 9 generates the musical tone having the tone color which is given in the stable up-bowing operation.

Next, when the performer changes over the bowing operation of the bowing control 11 to the down-bow operation at t32 shown in FIG. 11, the logical level of the waveform data reading state detecting signal ST is maintained at "0" level (i.e., ST=0) but the logical level of the signal FWD1 is changed over to "0" level (i.e., FWD1=0) by the operating direction detecting signal FWD.

At this time, the address reading state of the start address memory 21X and end address memory 22X is changed over such that the waveform data of the down-bow repeat waveform data portion $W_{LPB}$ (see FIG. 10) is to be read out. Herein, the waveform data from head address A2 to end address A2e is once read out, and then the waveform data from repeat start address A2s to end address A2e is repeatedly read from the waveform memory 6.

As a result, during the down-bow operation period BOWB between times t32, t33, the musical tone forming portion 9 can generate the musical tone having the tone color which is given in the stable down-bowing operation.

Further, when the performer changes over the bowing operation of the bowing control 11 to the up-bow operation at time t33 shown in FIG. 11, the logical level of the waveform data reading state detecting signal ST is maintained at "0" level but the logical level of the signal FWD1 is changed over to "1" level by the operating direction detecting signal FWD.

As similar to the up-bow operation period BOWF between times t31, t32, the address reading state of the start address memory 21X and end address memory 22X is controlled so that the musical tone forming portion 9 can generate the musical tone having the tone color which is given in the stable up-bowing operation.

FIG. 11 corresponds to the operations wherein after the key-on operation is made in the keyboard circuit 2 the bowing operation of the bowing control 11 is started from the down-bow operation, and then the bowing operation is alternatively changed over as the up-bow operation, down-bow operation, up-bow operation, . . . On the other hand, in the case where the bowing operation is started from the up-bow operation when the musical tone is started to be generated at the key-on timing, the waveform memory 6 is controlled such that the waveform data of the up-bow attack waveform data portion $W_{ATF}$, down-bow repeat waveform data portion $W_{LPB}$, up-bow repeat waveform data portion $W_{LPF}$, down-bow repeat waveform data portion $W_{LPB}$, . . . are sequentially read out.

In the second embodiment as shown in FIG. 9, by operating the bowing control 11 in up-bow direction or down-bow direction, the musical tone forming portion 9 can generate the musical tone whose tone color is slightly varied as similar to the delicate tone color variation given by the bowing operation of the non-electronic string bowing instrument.

[D] MODIFIED EXAMPLES (1) The embodiments described heretofore employs the modulation wheel as the bowing control 11. However, other mechanisms can be applied to this bowing control 11. For example, as the bowing control 11, it is possible to employ several kinds of mechanisms such as joy stick, ribbon controller, light pen, slide volume, mouse etc.

(2) The present embodiments provides two kinds of waveform data each corresponding to each of the up-bowing operation and down-bowing operation. Then, in response to the bowing operation of the bowing control 11, the waveform data to be read out is changed over. Instead, it is possible to obtain the same effect of tone color variation in the present embodiments by carrying out the interpolation operation on two series of waveform data. More specifically, two series of waveform data are simultaneously read out, wherein each series of waveform data corresponds to each of two tone colors. Herein, by carrying out the interpolation operation, the cross-fade is made so that one tone color corresponding to first series of waveform data is smoothly varied to another tone color corresponding to second series of waveform data.

(3) The present embodiments adopts the present invention to the monophonic electronic musical instrument. However, it is possible to adopt the present invention to the polyphonic electronic musical instrument. In this case, based on the time sharing system, plural musical tones are simultaneously generated by the polyphonic electronic musical instrument.

(4) In the present embodiments, the musical-tone-generation processing is made by the hardware system. Instead, it is possible to perform the musical-tone-generation processing by processing the musical tone signal by use of the software system.

(5) In the present embodiments relates to the electronic musical instrument wherein the sample value data of the musical tone waveform is stored in the waveform memory 6, and then the stored sample value data is read out in order to form the musical tone waveform. This invention is not limited to such kind of electronic musical instrument. More specifically, it is possible to apply the present invention to other kinds of electronic musical instruments which form the musical tone by use of frequency-modulation (FM) parameters, higher harmonic coefficient data etc.

(6) In the present embodiments, each tone color corresponding to different musical tone waveform. However, it is possible to provide plural waveform data with respect to each tone color. Herein, in response to the tone area difference, touch output variation etc., desirable waveform data is selected from plural waveform data with respect to each tone color.

(7) The present embodiments corresponds to the electronic musical instrument providing the keyboard. However, this invention can be applied to other kinds of electronic musical instruments providing the tone source unit, rhythm machine and the like.

(8) In the present embodiments as shown in FIGS. 1, 8, the operating direction detecting signals FWD, FWD1, tone color selecting signal TC and waveform data reading state detecting signal ST are used as the address selecting conditions of the start address memories 21, 21X and end address memories 22, 22X. In addition, it is possible to further use the key code signal KC as shown by dotted line in FIGS. 1, 8. In this case, based on the key code signal KC, it is possible to designate the data area of the waveform data to be read out depending on the tone area difference.

(9) In the present embodiments, the tone color selecting signal TC, waveform data reading state detecting signal ST and operating speed detecting signal ST are used as the control conditions of the filter coefficient generating circuit 31 and envelope signal generating circuit 32 as shown in FIGS. 1, 8. In addition, it is possible to use the key code signal KC as indicated by dotted line in FIGS. 1, 8. In this case, based on the key code signal KC, the tone color or envelope is controlled depending on the tone area variation.

(10) In the second embodiment as shown in FIG. 8, different waveform data are provided for the up-bow operation and down-bow operation as their attack waveforms. However, it is possible to use the common waveform data of the attack waveform for both of the up-bow operation and down-bow operation.

(11) In the present embodiments, the tone color is controlled in the tone color control circuit 7 based on the operating speed detecting signal SP generated from the operating speed detecting circuit 13. Instead of the operating speed to be detected, it is possible to detect the operating acceleration applied to the bowing control 11. In this case, based on the detected operating acceleration, the tone color is controlled.

As described heretofore, this invention can be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. An electronic musical instrument comprising:

(a) input means for generating operation information representative of the operation involved with manipulation of a bow by a musician playing a stringed instrument;

(b) detecting means for detecting an operation direction based on said operation information representative of a bowing direction;

(c) memory means for storing musical tone waveform data representative of musical tone waveforms generated from a string instrument played with bow;

(d) pitch information generating means for generating pitch information;

(e) musical tone signal generating means for reading out said musical tone waveform data by a speed corresponding to said pitch information to thereby generate a musical tone signal based on read musical tone waveform data; and (f) control means for controlling a read-out address at which said musical tone waveform data is to be read out in response to said operation direction detected by said detecting means, so that said control means controls a tone color of said musical tone signal in response to said bowing direction.

2. An electronic musical instrument comprising:

(a) input means for generating operation information representative of the operation involved with manipulation of a bow by a musician playing a stringed instrument;

(b) detecting means for detecting an operation direction based on said operation information representative of a bowing direction;

(c) memory means for storing a plurality of musical tone forming data corresponding to bowing directions;

(d) pitch information generating means for generating pitch information;

(e) musical tone signal generating means for reading out said musical tone forming data by a speed corresponding to said pitch information to thereby generate a musical tone signal based on read musical tone forming data; and (f) control means for designating one of said plurality of musical tone forming data corresponding to said operation direction detected by said detecting means, whereby said control means controls a tone color of said musical tone signal corresponding to designated musical tone forming data in response to said bowing direction.

3. An electronic musical instrument according to claim 1 or 2 wherein said bowing direction corresponds to one of up-bow and down-bow, so that the tone color of said musical tone signal is varied between said up-bow and down-bow.

4. An electronic musical instrument comprising:

(a) moveable operating means for carrying out an operation representative of the operation involved with manipulation of a bow by a musician when playing a stringed instrument;

(b) generating means for generating bowing information responsive to said operation and representative of a direction of movement of said operating means;

(c) tone control information generating means for generating tone control information corresponding to said bowing information; and (d) musical tone signal generating means for generating a musical tone signal in accordance with said tone control information.

5. An electronic musical instrument according to claim 4 further providing means for generating pitch information, whereby said musical tone signal has a pitch corresponding to said pitch information.

6. An electronic musical instrument according to claim 5 wherein said tone control information includes said pitch information and tone color information.

7. An electronic musical instrument according to claim 4 wherein said bowing information further includes data indicative of a bowing speed.

8. An electronic musical instrument comprising:

(a) input means capable of providing operation information representative of the operation involved with manipulation of a bow by a musician when playing a stringed instrument;

(b) detecting means for detecting a bowing direction based on said operation information;

(c) pitch information generating means for generating pitch information;

(d) tone control information generating means for generating tone control information corresponding to said bowing direction detected by said detecting means; and (e) musical tone signal generating means for generating a musical tone signal having a pitch corresponding to said pitch information and a tone color corresponding to said tone control information.

* * * * *